US007559429B1

(12) United States Patent
Ichimura

(10) Patent No.: US 7,559,429 B1
(45) Date of Patent: Jul. 14, 2009

(54) WIRE ROPE REEVING SYSTEM FOR TWIN LIFT CARGO CONTAINER HANDLING

(75) Inventor: Kinya Ichimura, Foster City, CA (US)

(73) Assignee: PACECO Corp., Hayward, CA (US)

( * ) Notice: Subject to any disclaimer, the term of this patent is extended or adjusted under 35 U.S.C. 154(b) by 0 days.

(21) Appl. No.: 12/214,480

(22) Filed: Jun. 18, 2008

(51) Int. Cl.
*B66C 17/00* (2006.01)

(52) U.S. Cl. ..... 212/316; 212/274; 212/323

(58) Field of Classification Search ..... 212/316, 212/278, 323
See application file for complete search history.

(56) References Cited

U.S. PATENT DOCUMENTS

| | | | | |
|---|---|---|---|---|
| 3,536,351 | A * | 10/1970 | Zweifel et al. | 294/81.1 |
| 3,671,069 | A * | 6/1972 | Martin et al. | 294/81.1 |
| 3,874,516 | A * | 4/1975 | Watanabe | 212/87 |
| 6,631,816 | B1 * | 10/2003 | Miyazawa et al. | 212/272 |
| 7,040,496 | B2 * | 5/2006 | Hakala | 212/274 |
| 2006/0243724 | A1 * | 11/2006 | Shan | 220/1.5 |

* cited by examiner

*Primary Examiner*—Thomas J. Brahan
(74) *Attorney, Agent, or Firm*—Bruce & McCoy; Ernest H. McCoy

(57) ABSTRACT

A single wire rope reeving system for a twin lift cargo container handling crane for hoisting and lowering a pair of containers in side-by-side relation independently or simultaneously.

6 Claims, 4 Drawing Sheets

| | HOIST SPEED | | CONTROL SPEED | |
|---|---|---|---|---|
| | V1 | V2 | V3 | V4 |
| HOIST UP/DOWN BOTH 2 CONTAINERS | 1 | 1 | 4 | 2 |
| HOIST UP/DOWN ONLY CONTAINER 1 | 1 | 0 | 2 | 0 |
| HOIST UP/DOWN ONLY CONTAINER 2 | 0 | 1 | 2 | 2 |
| TROLLEY TRAVERSING | 0 | 0 | 0 | Vt |

*FIG.–4*

WIRE ROPE REEVING SYSTEM FOR TWIN LIFT CARGO CONTAINER HANDLING

BACKGROUND OF THE INVENTION

1. Field of the Invention

The present invention relates primarily to dockside cranes utilized in cargo container handling operations for transporting cargo containers between the ship and shore. More particularly, the present invention relates to a wire rope reeving system for cargo container lifting spreader apparatus which are translated by said cranes. Still more particularly, the present invention relates to twin container lift apparatus for engaging two containers by independent lifting spreaders for simultaneous side-by-side movement and for lifting and lowering said two cargo containers, simultaneously and independently, by a single wire rope reeving system, while the containers are suspended at one location or being transported horizontally by the crane.

2. Description of the Prior Art

The utilization dockside of various types of cargo container handling gantry cranes, or quay cranes, for the purpose of loading and unloading of cargo container transport ships, is highly and diversely developed in the prior art. The reason is that shipping companies wish to reduce the time a ship spends in port involved in berthing operations (offloading and loading) in order to increase the efficiency of each vessel.

Quay crane container handling rates are measured in cycle rates. Unsteady quay crane operations result because the cranes move containers different distances depending upon the deposition location of the container on a ship causing varying the cycle rates. For example, as a quay crane loads or unloads each column of containers spaced across the beam of the ship, the hoist travels a longer distance outboard for each successive column of containers and lowers and hoists longer for each container located deeper in the stack. The increased traveling distance and stationary time for the hoist, for each successive container, adds to the container handling time and the resulting cycle time. Increasing productivity through reducing a ship's down time is essentially accomplished by permitting ships to be unloaded and loaded faster. Efforts are continuously being made to further this objective, and the present invention of concurrent multiple container handling is still another advancement in these efforts.

However, despite the numerous designs, structures, and forms of cargo container handling cranes disclosed by the prior art, which all have been developed for the accomplishment of the specific objectives, purposes, and requirements of reducing a ship's down time, the devices and apparatus which have been heretofore devised and utilized consist basically of familiar, expected, and obvious, configurations, combinations, and arrangements of well-known methods and machinery. This will become apparent from the following consideration of the closest known and relevant prior art.

Reference is made to FIG. 1 of the drawings which shows a typical dockside berthing operation for a ship. The primary container handling equipment is comprised of one or more quay cranes 11 which move on rails along the wharfs edge 13. A retractable boom or gantry 15 extends between at least two pickup and deposition positions such as a dock and a ship 17. The gantry in operative position is cantilevered outboard from the dock to extend over a berthed ship. The crane has a transport trolley or trolleys 19 mounted thereon for reciprocating travel on rails mounted on the gantry. Cargo shipping containers which have been unloaded or are to be loaded are temporarily stored in a stacking yard proximate to the ship loading berths.

In ship loading operations, cargo container transporters 21, such as chassis trucks, trailer trucks, or automatically guided vehicles (AGVs), deliver the containers 23 from the stacking yard to dockside. There, the quay cranes lift the cargo containers 23 from the dockside container transporters, or from an intermediate buffer mechanism or crane, and move them up and over the ship 17 where they are lowered into shipboard cells. The reverse occurs in ship unloading operations; the quay cranes access the shipboard cargo containers from above the ship and move them dockside and to the ground level or onto dockside transporters or intermediate buffer container holding mechanisms.

To decrease the cycle rate and increase the efficiency of the berthing operations, cranes were developed to transport two containers simultaneously between a ship and dockside. In 1970, a system for handling two containers simultaneously, end to end, or in tandem, was patented (U.S. Pat. No. 3,536,351 to Zweifel et. al.) by the predecessor company to the present assignee. Many variations followed.

A problem with those designs developed when increased and variable lengths of containers were put in use. When the standard length of a container was 20 feet, a crane could easily lift a pair of containers end-to-end. However, when container lengths commonly reached 40 feet, two containers of that length could not be lifted end-to-end by the quay crane apparatus disclosed by the prior art patents for several reasons. The containers would extend more than 20 feet past the ends of the lifting spreaders with only 20 feet of one end of each engaged by a spreader. The loads were too great. Lifting just one 20-foot container without another container in the other tandem spreader imposes a severe imbalance on the crane gantry. Obviously cranes can be designed to handle such imbalances but that requires a reinforced crane structure or a different crane design.

Early on it was determined that twin lifting of two containers solved the imbalance problems. Japanese patent S54-6267 discloses this arrangement (in 1979). However, the container handling cycle rates for the tandem or twin lift methods for cargo container handling can be improved still further for reducing cycle times. The twin lifting cargo container handling crane contemplated according to the present invention departs substantially from the conventional concepts and designs taught by the prior art, and, in doing so, provides a wire rope reeving apparatus primarily developed for the purpose of increasing still further the efficiency of ship berthing operations. It accomplishes the result in a different and improved manner and with a less expensive machinery requirement than the methods and apparatus of the prior art.

The present invention is a further improvement on these inventions and a substantial improvement for reducing crane cycle times. It increases still further the efficiency of a twin lift capable cargo container handling crane by permitting lifting and lowering the containers concurrently and independently with a single wire rope reeving system.

SUMMARY OF THE INVENTION

In view of the foregoing known and obvious disadvantages inherent in the prior art types of twin lift cargo container handling quay cranes and berthing operations, presently existing and utilized in seaports, the present invention provides a new twin lift crane construction for quay crane operation wherein the same can be utilized to improve the efficiency of cargo container ship berthing operations.

The general purpose of the present invention, which will be described hereafter in greater detail, is to provide a new twin lift crane apparatus and function which has all of the advantages of the prior art mentioned above, as well as many novel features that result in new methods of cargo container handling in berthing operations, which are not anticipated, rendered obvious, suggested, or even implied by any of the prior art of quay crane wire rope reeving systems either alone or in any combination thereof.

The present invention is a method and apparatus comprising a wire rope reeving system for a single wire twin lift cargo container handling crane. It employs a pair of parallel aligned container transport trolleys mounted for reciprocation along a horizontal gantry thereof for suspending a pair of cargo containers thereunder to transport the containers between pickup and deposition positions simultaneously with the defining characteristic of having the capability to lift and lower the containers independently with what is defined as a single wire rope reeving system for the crane and trolleys.

The more important features of the invention have been broadly outlined in order that the detailed description thereof which follows may be better understood and in order that the present contribution to an improvement in the art may be better appreciated. There are additional features of the invention that will be described hereinafter and which will form the subject matter of the claims appended hereto.

With respect to the claims hereof, and before describing at least one preferred embodiment of the invention in detail, it is to be understood that the invention is not to be limited in its application to the details of construction and to the arrangements of the components which are set forth in the following description or illustrated in the drawings. The invention is capable of being created in other embodiments and of being practiced and carried out in various ways. Also, it is to be understood that the phraseology and terminology employed here are for the purpose of description and should not be regarded as limiting.

As such, those skilled in the art will appreciate that the conception upon which this disclosure is based, may readily be utilized as a basis for the designing of other forms, structures, methods, and systems for carrying out the several purposes of the present invention. It is important, therefore, that the claims be regarded as including such equivalent constructions in so far as they do not depart from the spirit and scope of the present invention.

Further, the purpose of the appended abstract is to enable the United States Patent and Trademark Office, and the public generally, and especially scientists, engineers and practitioners of the art who are not familiar with the patent and legal terms or phraseology, to determine quickly from cursory inspection the nature and essence of the technical disclosure of the application. The abstract is neither intended to define the invention of the specification, which is measured by the claims, nor is it intended to be limiting as to the scope of the invention in any way.

OBJECTS OF THE INVENTION

It is therefore an important object of the present invention to provide a new and improved wire rope reeving system for a twin lift cargo container handling quay crane.

It is another object of the present invention to provide a wire rope reeving system for twin lift cargo container handling quay crane which can transport different length containers concurrently.

It is a further object of the present invention to provide a wire rope reeving system for a twin lift cargo container handling crane which can lift and lower containers independently by means of a single wire rope reeving system.

It is still another object of the present invention to provide a twin lift cargo container handling crane which does not require interconnection between either the transport trolleys or the two lifting spreaders which suspend the containers.

And it is yet a further object of the present invention to provide a new and novel method for independent lifting and lowering of cargo containers by a twin lift crane by means of a single wire rope reeving system.

Other objects and advantages of the present invention will become apparent when the method and apparatus of the present invention are considered in conjunction with the accompanying drawings.

DESCRIPTION OF THE DRAWINGS

FIG. 4 is a is a performance chart for the single wire rope twin lift reeving system for a quay crane employing the present invention.

DESCRIPTION OF THE PREFERRED EMBODIMENT

Reference is made to the drawings for a description of the preferred embodiment of the present invention wherein like reference numbers represent like elements on corresponding views.

Figure 1:
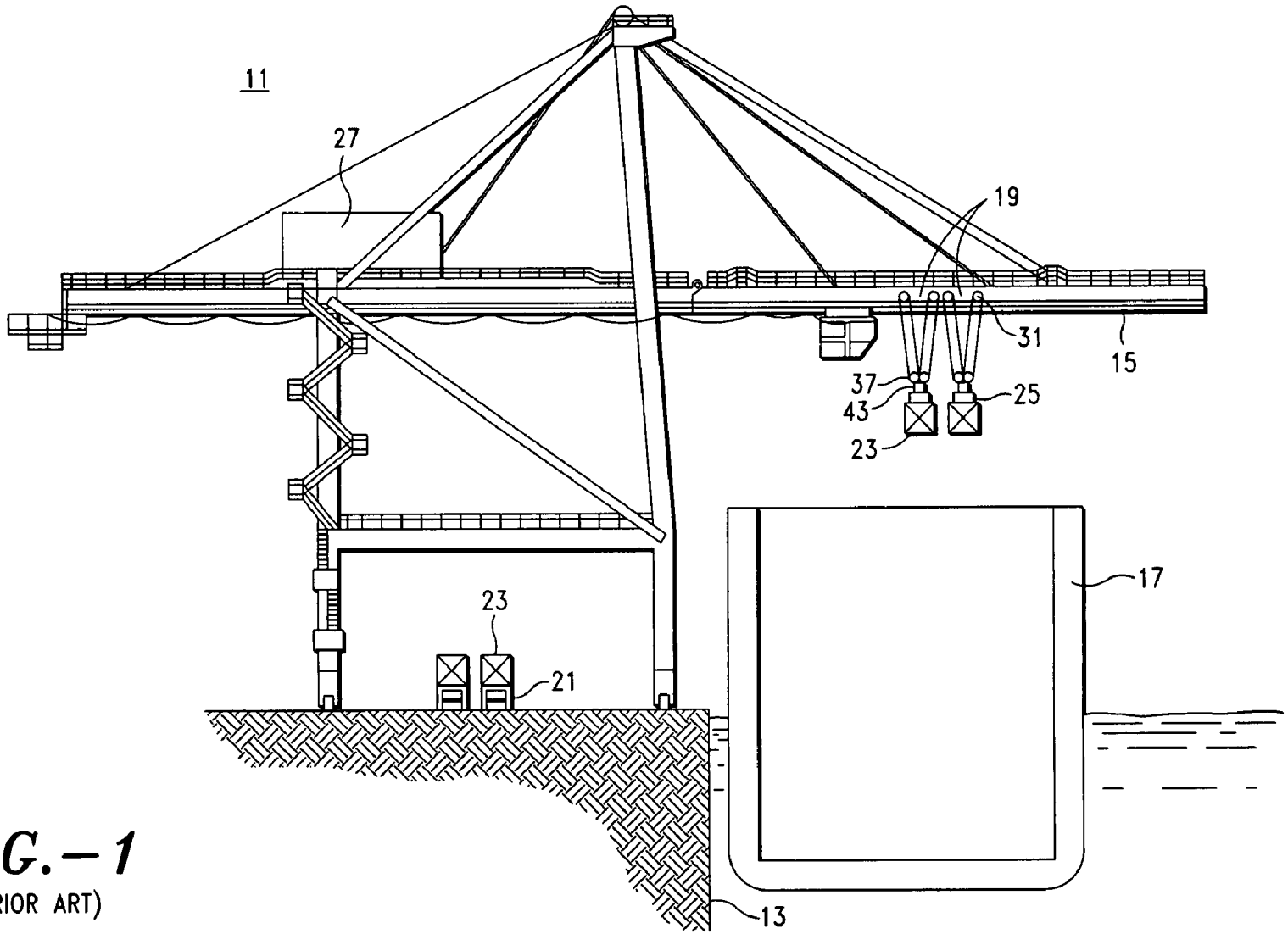
FIG.—1 (PRIOR ART)
FIG. 1 is a side elevation of a typical quay crane of a ship berthing operation.
Figure 2:
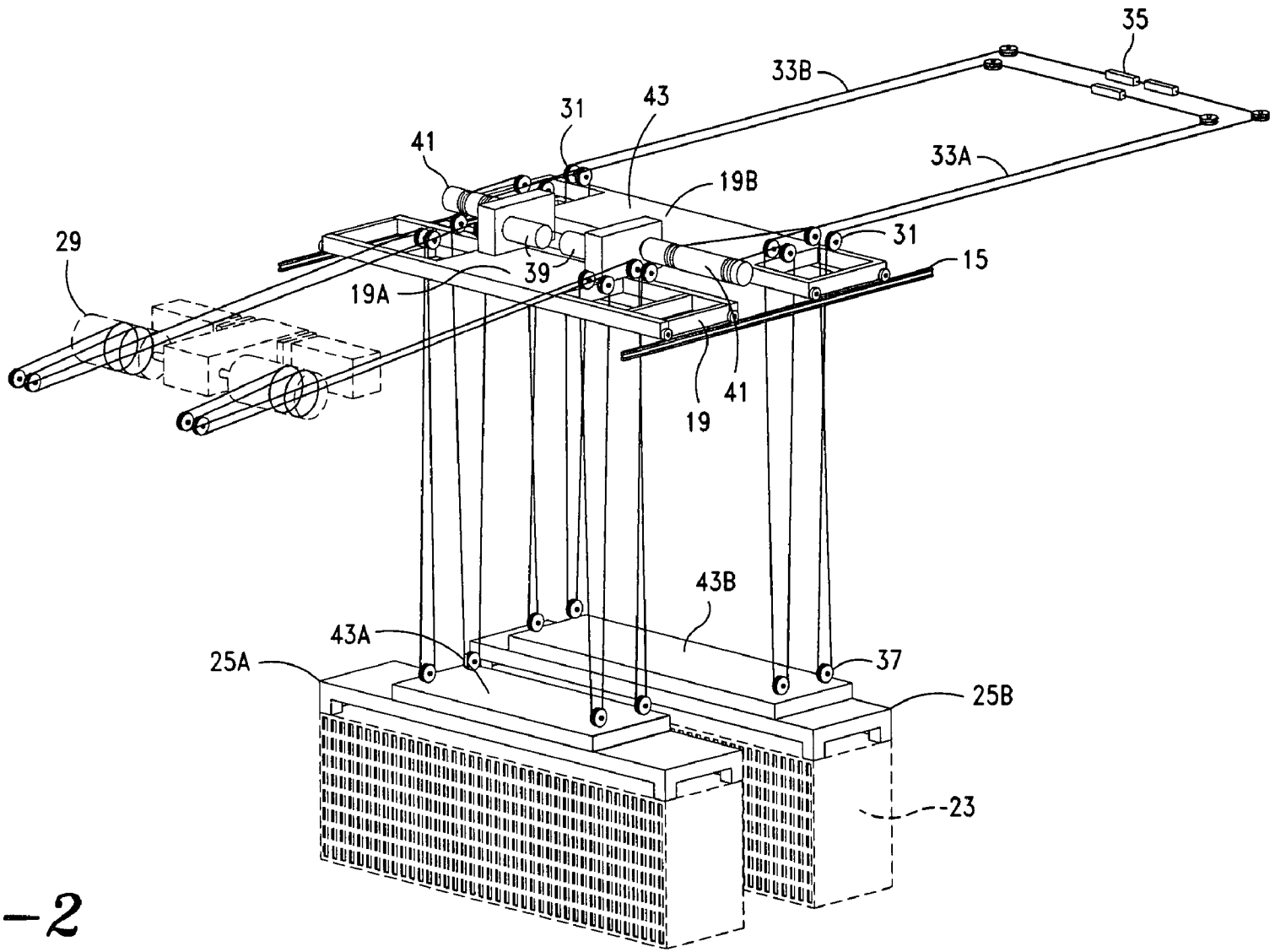
FIG. 2 is a perspective view of wire rope reeving system for a twin lift cargo container handling crane of the present invention.

Reference is made to FIGS. 1 and 2 of the drawings which show a typical dockside berthing operation for a ship. The primary cargo container handling equipment is comprised of one or more quay cranes 11 which extend outboard from the dock's edge 13 across the beam of a ship 17 which is located dockside in a shipping port. While a quay crane is the most logical and prevalent expected use for the wire rope reeving system of the present invention, it is contemplated that the twin lift cargo container handling system could also be utilized on a railroad stacking yard bridge crane, as well as dockside, or possibly utilized with a straddle crane, so the term "quay crane" as used herein is intended to include these alternative types of cargo container handling cranes as well.

The single wire rope reeving system of the present invention is provided for twin lift cargo container handling by a quay crane 11 which means that the crane is capable of lifting, transporting, and lowering two cargo containers 23 simultaneously to essentially double the operating capacity of the crane. The term "single wire rope reeving system" will be further defined herein.

In order to effect twin lifting as contemplated by the present invention, a pair of parallel aligned cargo container transport trolleys 19 are employed mounted for either independent or coordinated reciprocation along horizontal rails on the gantry 15 of the crane. The transport trolleys are also called cargo container lifting spreader suspension trolleys as each individually suspends one of a pair of lifting spreaders 25A & 25B thereunder. The spreaders are utilized to engage and transport cargo containers 23 between pickup and deposition positions simultaneously or independently and, by means of the present invention, to lift and lower them independently with a new and novel integrated wire rope reeving system.

The two cargo containers 23 are engaged by separate lifting spreaders 25 disposed in parallel aligned orientation so that the loads are concentrated and balanced under the center of the crane gantry, whether one or two containers are lifted simultaneously, rather than off-balance as would occur if only one cargo container were being elevated by a tandem lift spreader. The parallel aligned trolley/lifting spreader combinations effect a twin lift system which can handle different length cargo containers simultaneously because of the balanced weight distribution under the crane gantry when the cargo containers are elevated by the crane transport trolleys.

The wire rope reeving system of the present invention can be employed whether the transport trolleys 19 are formed to reciprocate with respect to each other in a direction collinear with the reciprocating directions of travel of the trolleys on the gantry rails 15 or if they are formed for integrated movement. Thus, the trolleys can be independent or interconnected and are usually controlled by either a single or by separate wire rope drive systems (not shown) usually driven by wire rope trolley drive drums (not shown) located in a machinery house 27. Computer controls for the trolley drive drums monitor the positions and dynamic conditions of the trolleys to prevent collisions, if they are independently operated, and arrest unsafe sway of the suspended loads.

Figure 3:
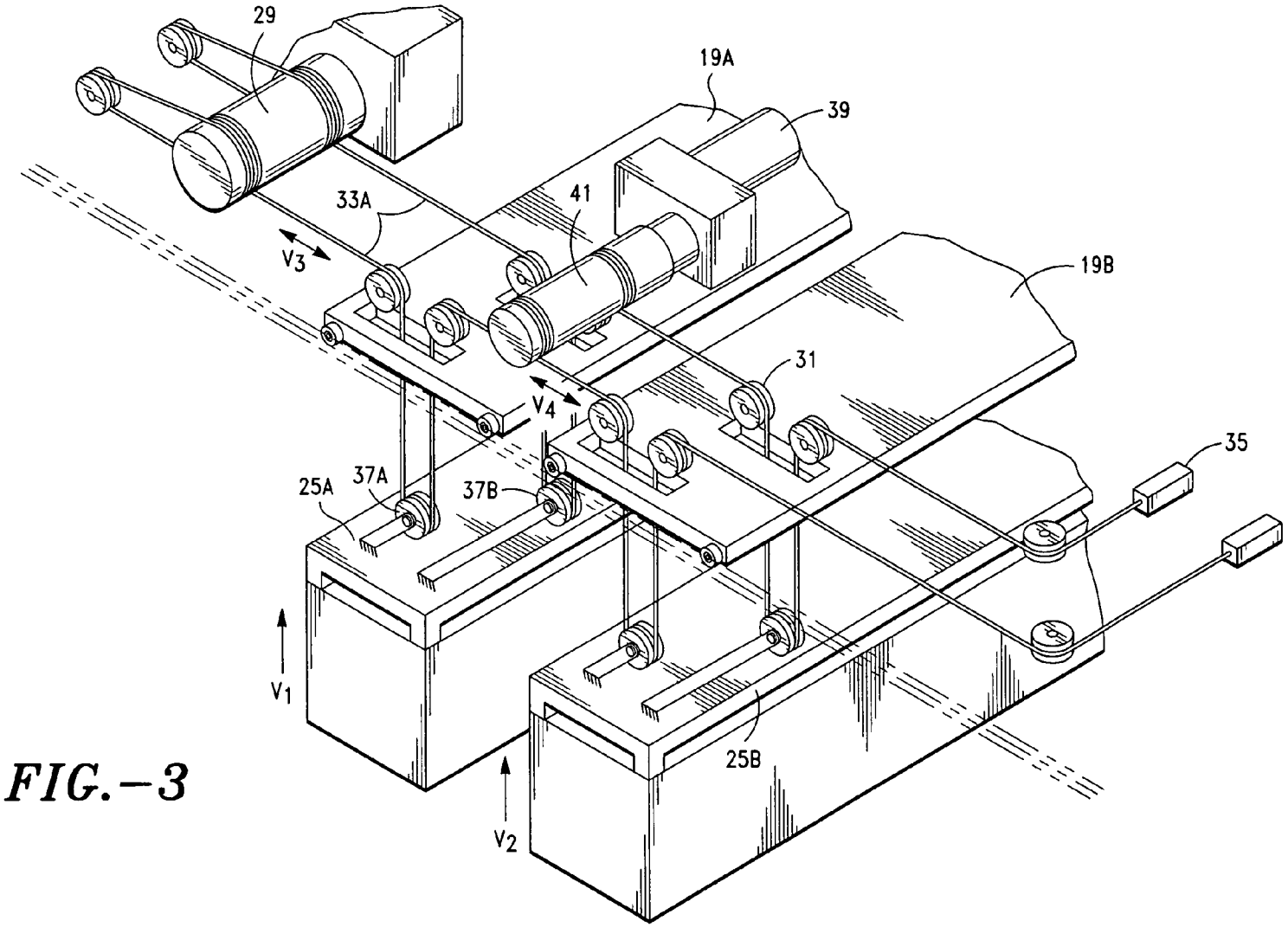
FIG. 3 is a is a perspective broken out representational view of one half of the cargo container single wire rope twin lift reeving system of the present invention.

Reference is made to FIGS. 2 & 3. The pair of separate lifting spreaders 25 are suspended from the spreader suspension trolleys 19 by means of a single wire rope reeving system for engaging parallel aligned containers in side-by-side orientation. The spacing between the cargo containers is immaterial (except for preventing collisions and container sway) if the trolleys are capable of operating independently in horizontal travel on the gantry 15. Hoisting and lowering the lifting spreaders independently with a single wire rope system is the capability of the present invention. The wire rope reeving suspending the spreaders (by means of head blocks) is driven from wire rope sheave drive drums 29 disposed on the gantry of the quay crane 11 and fleets through sheaves 31 mounted on the spreader suspension trolleys.

The reeving of the wire ropes shown in FIG. 2 cannot be clearly represented due to the small size and complexity of the perspective view representation. The essential reeving is more accurately shown in FIG. 3. However, a similar problem of representation, with respect to the sheave locations on the head block/lifting spreader combination, occurs in FIG. 3. Reference is made to FIG. 2. The positioning of the fleet through sheaves 37 is more accurately represented shown therein mounted at the corners of the head blocks 43. In FIG. 3, the sheaves 37 are falsely shown suspended in the air and spindled by stretched (false) connections but correctly connected to the corners of the spreaders 25 (instead of connected to the corners of the head blocks which have been omitted/integrated into the spreaders). The head blocks with sheaves correctly mounted and oriented thereon as shown in FIG. 2 have been omitted from FIG. 3 in order to clarify the wire rope reeving orientation represented by FIG. 3.

These problems of representation are immaterial, however, because the technology is over 40 years old and well developed in the cargo container handling art and readily understood by layman let alone those skilled in the art. All of the wire rope reeving and sheaves on the trolleys 19, for suspending the lifting spreaders 25 and for the head blocks 43 which engage the lifting spreaders, is standardized quay crane cargo container handling machinery.

Usually the wire rope sheave drive drums 29 are mounted in a machinery house 27 disposed at the shoreside end of the gantry 15 of the quay crane. Alternatively, the sheave drive drums could be mounted on one of the trolleys, but that design has the defect of imposing heavier loads on the crane gantry especially if it is of a cantilevered design. If the drums are mounted on a trolley, rather than in a remote machinery house, usually positioned above a crane support leg, the drums are in effect still mounted on the gantry of the quay crane for purposes of the language of the accompanying claims. In fact, it is possible that the drive drums could be mounted anywhere on the crane and the wire ropes routed by sheaves to the gantry and that would still be the equivalent of mounted on the gantry, but such an arrangement would be impractical although still within the concept of the invention.

Reference is made to FIGS. 2 & 3. FIG. 3 of the drawings represents one half of the single wire rope reeving system. A mirror image reeving system to FIG. 3 engages the other ends of the trolleys 19 and spreaders 25. The twin lift wire rope reeving system, driven by the main wire rope drive drums 29 on the crane gantry 15, each actuate a pair of wire ropes 33A & 33 B which extend outboard to the end of the gantry where they are dead ended 35. Each of the pair of wire ropes suspends opposite ends of both of the lifting spreaders 25A & 25B. A single wire rope system in this context means one wire rope system drives the separate lifting and lowering of loads by both of the two trolleys rather than having two independent wire rope systems, with separate drive motors, which would independently and separately control the lifting and lowering of the two trolley's suspended spreaders.

At each end of the trolleys 19 and spreaders 25, the pairs of wire ropes 33A & 33B are reeved over fleet through sheaves 31 on the trolleys, down and around fleet through sheaves 37 mounted on at the corners of the lifting spreader head blocks 43, suspended below the trolleys, back up to the trolleys and over additional fleet through sheaves 31 thereon, and then out to the end of the gantry 15 where they are dead ended 35.

A pair of motor 39 driven wire rope sheave drive drums 41 are mounted at opposite ends of one of the transport trolleys 19 called the machine trolley 19A. Each sheave drive drum is of the fleet around type and controls the wire ropes of one of the pair of wire ropes 33A & 33B at opposite ends of the trolleys. The sheave drive drums on the trolleys move the respective wrapped around wire rope and are controlled separately of the main wire rope drive drums 29 disposed in the machinery house 27 whereby the rotational speeds thereof are independent of the main drive drums and whereby the lifting spreaders can be lifted and lowered independently.

Not shown are the separate sets of trolley drive motors and wire rope drive drums mounted at the end of the gantry (in the machinery house), having wire drive ropes secured to the trolleys, which independently operate/move the trolleys. Alternatively, the trolleys could be interconnected at a fixed spaced relation with respect to each other, thereby eliminating the expense and need for one set of trolley drive motors but as a result reducing the capability or versatility of the crane. The trolley drive motors could be mounted on the trolleys and drive the wheels thereof directly, but this would increase the gantry design loading and thereby the cost and designed weight of the gantry. In any design of the transport trolley drives, computer safety controls prevent the trolleys from colliding or hitting the ends of the gantry.

An example demonstrates how the single wire rope container suspension system works. Reference is made to FIG. 3 for this explanation. In a first condition, the sheave drive wire rope drums 41 on the machine trolley 19A are locked, both trolleys 19 are braked (held against movement on the rails), and the main wire rope drive drums 29 are activated: the lifting spreader 25A under the machine trolley with the sheave drive drums thereon, is thereby raised or lowered. In a second condition, both trolleys are braked, both the main wire rope drive drums 29 on the gantry and the sheave drive drums 41 on the machine trolley are actuated to move the wire rope pairs 33A & 33B at the same speed: the lifting spreader 25B under the passive trolley 19B is raised or lowered. Therefore, selectable differential speeds between the main drive drums and the sheave drive drums, integrated with independent speed control of the trolleys, permit the lifting spreaders to be raised or lowered independently even while the two trolleys are likewise moving independently.

Reference is made to FIG. 4 of the drawings which is a performance chart for the ratio of relative speeds in the single wire rope twin lift reeving system for a quay crane employing the present invention. V1 & V2 are the vertical hoist speeds of the cargo container lifting spreaders. V3 represents the rope speed controlled by the wire rope drum 29. V4 represents the rope speed controlled by the wire rope drive drums 41. In the case of trolley traversing, V4 is controlled by the trolley traversing speeds Vt. This system permits independent tandem lifting by a cargo container handling crane by a single wire rope reeving system.

These differential speeds can be controlled by hand (stick) throttles in the operators cab which comprise analog sliding speed controls combined with computer-controlled safety programs which control the speed and acceleration of the trolleys to minimize container sway and prevent collisions. Additional computer control can be included to the point that the operator just has controls for up and down buttons for the lifting spreaders and separate speed controls for the two trolleys. Sophisticated computer sensor controlled positioning of the lifting spreaders for engaging containers and lowering them into shipboard cells or onto dockside transporters are also utilized and available for inclusion in the system.

The present invention also includes the method of operation of a wire rope reeving system for twin lift cargo container handling by a crane. The method comprises providing a single wire rope reeving system having a pair of parallel aligned container transport trolleys mounted for reciprocation along a horizontal gantry of the crane for suspending a pair of cargo containers thereunder for transporting said containers between pickup and deposition positions simultaneously. A pair of synchronously driven main wire rope drive drums are provided mounted on the gantry of the crane, each actuating a pair of wire ropes which extend outboard to the end of the gantry where they are deadended. The pairs of wire ropes are reeved through fleet through sheaves on the trolleys and through fleet through sheaves on the lifting spreader headblocks suspended below the trolleys by the wire ropes. Each of the pair of wire ropes suspend opposite ends of both of the spreaders. A pair of motor driven wire rope sheave drive drums are provided mounted at opposite ends of one of the trolleys and drive one pair of the wire ropes at respective opposite ends of the trolley. The sheave drive drums on the trolleys are capable of having rotational speeds independent of the main drive drums disposed in the machinery house whereby the lifting spreaders can be lifted and lowered independently.

The rotational speeds of the main wire rope drive drums and the sheave drive wire rope drums can be controlled by analog hand throttles. Alternatively, the rotational speeds of the main wire rope drive drums and the sheave drive wire rope drums can be controlled by computer.

Thus, it will be apparent from the foregoing description of the invention in its preferred form that it will fulfill all the objects and advantages attributable thereto. While it is illustrated and described in considerable detail herein, the invention is not to be limited to such details as have been set forth except as may be necessitated by the appended claims.

I claim:

1. A wire rope reeving system for single wire twin lift cargo container handling by a crane, said crane having a pair of parallel aligned container transport trolleys mounted for reciprocation along a horizontal gantry thereof and for suspending a pair of cargo containers thereunder for transporting said containers between pickup and deposition positions simultaneously, said reeving system comprising a pair of synchronously driven main wire rope drive drums mounted on the gantry of said crane, each actuating a pair of wire ropes which extend outboard to the end of said gantry where they are deadended, said pairs of wire ropes reeved through fleet through sheaves on said trolleys and through fleet through sheaves on lifting spreader headblocks suspended below said trolleys by said wire ropes, each of said pair of wire ropes suspending opposite ends of both of said spreaders, a pair of wire rope sheave drive drums mounted at opposite ends of one of said trolleys and driving one pair of said wire ropes at respective opposite ends of said trolley, said sheave drive drums on said trolleys capable of having rotational speeds independent of said main drive drums disposed in said machinery house whereby said lifting spreaders can be lifted and lowered independently.

2. The wire rope reeving system of claim 1 wherein the rotational speeds of said main wire rope drive drums and said sheave drive wire rope drums are controlled by analog hand throttles.

3. The wire rope reeving system of claim 1 wherein the rotational speeds of said main wire rope drive drums and said sheave drive wire rope drums are controlled by computer.

4. A method for twin lift cargo container handling by a single wire rope reeving system comprising providing a pair of parallel aligned container transport trolleys mounted for reciprocation along a horizontal gantry thereof and for suspending a pair of cargo containers thereunder for transporting said container between pickup and deposition positions simultaneously, providing a pair of synchronously driven main wire rope drive drums mounted on the gantry of said crane, each actuating a pair of wire ropes which extend outboard to the end of said gantry where they are deadended, said pairs of wire ropes reeved through fleet through sheaves on said trolleys and through fleet through sheaves on lifting spreader headblocks suspended below said trolleys by said wire ropes, each of said pair of wire ropes suspending opposite ends of both of said spreaders, and providing a pair of wire rope sheave drive drums mounted at opposite ends of one of said trolleys and driving one pair of said wire ropes at respective opposite ends of said trolley, said sheave drive drums on said trolleys capable of having rotational speeds independent of said main drive drums disposed in said machinery house whereby said lifting spreaders can be lifted and lowered independently.

5. The method for twin lift cargo container handling by a single wire rope reeving system of claim 4 whereby controlling the rotational speeds of said main wire rope drive drums and said sheave drive wire rope drums are controlled by analog hand throttles.

6. The method for twin lift cargo container handling by a single wire rope reeving system of claim 4 whereby controlling the rotational speeds of said main wire rope drive drums and said sheave drive wire rope drums are controlled by computer.

* * * * *

UNITED STATES PATENT AND TRADEMARK OFFICE

CERTIFICATE OF CORRECTION

PATENT NO. : 7,559,429 B1
APPLICATION NO. : 12/214480
DATED : July 14, 2009
INVENTOR(S) : Kinya Ichimura It is certified that error appears in the above-identified patent and that said Letters Patent is hereby corrected as shown below:

In col. 1, line 11, "for cargo" should read --for a cargo--.
In col. 1, line 12, "are" should read --is--.
In col. 1, line 32, "the" should be deleted between "varying" and "cycle."
In col. 1, line 51, "obvious, configurations" should read --obvious configurations--.
In col. 1, line 58, "wharfs" should read --wharf's--.
In col. 3, line 61, "for twin" should read --for a twin--.
In col. 6, line 41, "of the main wire" should read --from the main wire--.

Signed and Sealed this

Ninth Day of November, 2010

David J. Kappos

David J. Kappos
*Director of the United States Patent and Trademark Office*